United States Patent [19]

Neil et al.

[11] Patent Number: 4,889,066

[45] Date of Patent: Dec. 26, 1989

[54] SUBMERSIBLE VEHICLE

[75] Inventors: Alan Neil, Lachine; Gary W. Hesketh, St. Bruno; Gary Bojeck, Longueuil, all of Canada

[73] Assignee: Blue Space Submersibles, Inc., Quebec, Canada

[21] Appl. No.: 201,549

[22] Filed: Jun. 2, 1988

[51] Int. Cl.[4] ..... B63C 11/00

[52] U.S. Cl. ..... 114/334; 114/312; 114/314

[58] Field of Search ..... 114/312, 314, 66, 315, 114/330, 331, 334, 339; 272/1 B; 137/81.2, 206, 209, 213, 214

[56] References Cited

U.S. PATENT DOCUMENTS

| | | | |
|---|---|---|---|
| 2,887,977 | 5/1959 | Piry | 114/16 |
| 3,051,114 | 8/1962 | Bajulaz | 114/16 |
| 3,204,596 | 9/1965 | Fallon | 114/16 |
| 3,257,982 | 6/1966 | Meldrum | 114/16 |
| 3,369,368 | 2/1968 | Wilson | 114/334 |
| 3,387,580 | 6/1968 | Walker | 114/334 |
| 3,408,822 | 11/1968 | Chase | 114/334 |
| 3,543,526 | 12/1970 | O'Neill et al. | 61/69 |
| 3,618,551 | 11/1971 | Deslierres | 114/61 |
| 3,621,802 | 11/1971 | McGinn, Jr. | 114/16 |
| 3,664,366 | 5/1972 | Munguet | 137/209 |
| 3,751,030 | 8/1973 | Winters | 272/1 B |
| 3,757,721 | 9/1973 | Ohishi | 114/16 |
| 3,791,327 | 2/1974 | Deveney | 114/16 |

FOREIGN PATENT DOCUMENTS

| | | | |
|---|---|---|---|
| 1042443 | 6/1958 | Fed. Rep. of Germany | 114/312 |
| 1420980 | 1/1965 | France | 114/312 |
| 634991 | 2/1962 | Italy | 114/312 |

*Primary Examiner*—Joseph F. Peters, Jr.
*Assistant Examiner*—Clifford T. Bartz
*Attorney, Agent, or Firm*—Wolf, Greenfield & Sacks

[57] ABSTRACT

A self-propelled submersible vehicle which comprises a hull and a cockpit defined within the hull, a transparent dome on the top of the hull formed with the cockpit and enclosure walls defining the cockpit within the hull. The cockpit is open ended at the bottom thereof, and the hull is non-watertight. Compressed air tanks are provided in the hull, and these tanks communicate with a regulator valve which provides a constant flow of air into the cockpit forming an air bubble providing a breathable section of the cockpit for the passengers. An air exhaust device is incorporated with the regulator valve assembly for controlling the volume of the air bubble within the cockpit in response to the water level within the cockpit.

9 Claims, 8 Drawing Sheets

5
18
28
12

26
10
24
20
22
36
14
16
5

70
12
28
18
26
54
58
56
38
52
50
24
66
48
30
68
34
44
46
20
66
22
70
32
36
66
62
7
7
68
24
104
34
38
14
70

SUBMERSIBLE VEHICLE

BACKGROUND OF THE INVENTION

1. Field of the Invention

The present invention relates to a submersible non-watertight vehicle, and more particularly, to a miniature submersible vehicle suitable for one-or multiple-man underwater operations.

2. Description of the Prior Art

Miniature submersible non-watertight vehicles are known in the art as exemplified by U.S. Pat. Nos. 3,618,551, 1971, Deslierres; 3,257,982, 1966, Meldrum; 3,204,596, 1965, Fallon; and 3,051,114, 1962, Bajulaz. The Deslierres, Meldrum, and Fallon patents all show miniature submersible vehicles having flooded cockpits, wherein the divers or passengers must wear personal breathing equipment in order to ride in the vehicle. In the Fallon vehicle, the passenger may breathe from compressed air tanks provided in the vehicle. However, all of these vehicles can be classed as flooded passenger compartment vehicles. The Bajulaz vehicle includes a watertight compartment for the passengers, including a chimney for supplying fresh air, and is thus limited as to the depth the vehicle can dive.

There is a need for a submersible vehicle which is non-watertight and thus allows divers to have unimpeded access thereto but which has an air filled cockpit allowing the divers to dispense with cumbersome personal breathing equipment.

SUMMARY OF THE INVENTION

It is an aim of the present invention to provide a non-watertight submersible vehicle having a cockpit at least part of which is transparent and which contains a trapped air bubble sufficient to allow one or more passengers to breathe normally within the air bubble within the cockpit without the aid of auxiliary breathing equipment and wherein the volume of the air bubble can be maintained constant regardless of the depth to which the vehicle may be brought.

It is a further aim of the present invention to provide a self-propelled miniature submersible vehicle which has improved maneuverability as well as easy access for the passengers to ingress or egress from the cockpit at different depths.

In a construction in accordance with the present invention, there is provided a submersible vehicle having a hull, a cockpit within the hull, and a canopy having at least a transparent portion extending over the cockpit and forming the top wall thereof. The hull defines enclosure walls for the cockpit, and the walls are sealed to the canopy. The hull defines an open accessway to the cockpit to allow passengers unimpeded access to the cockpit from the underside of the hull. Means are provided for supplying air to the cockpit to form an air bubble large enough to allow the passengers to breathe freely within the cockpit, and means are provided for regulating the volume of the air bubble within the cockpit in order to neutralize the buoyancy of the cockpit.

In a more specific construction in accordance with the present invention, there is provided a non-watertight submersible vehicle including a hull, an open bottom cockpit having enclosure walls and a canopy which is at least partially transparent. Compressed air storage means are provided in the hull, and conduit means communicate the compressed air storage means to the cockpit for providing an air bubble within the cockpit. A regulating valve is provided on the conduit means to regulate the ingress of air from the compressed air storage means, and an air egress control means is coordinated to determine with the regulating valve the volume of air within the cockpit forming the air bubble at varying depths.

In a further embodiment of the present invention, there is provided a regulating valve which is adapted to be mounted on an enclosure wall of the cockpit. The regulating valve normally provides for a constant flow of air from the compressed air storage means to the cockpit by means of an ingress port in the cockpit. A gravity operated, lighter-than-water, float member is operably connected to the regulating valve for overriding the valve in response to the volume of the air bubble in the cockpit such that when the float member is at its predetermined lowest position, the regulating valve is in its normal constant flow position, and as water rises in the cockpit, thus reducing the volume of the air bubble and raising the float member, the regulating valve will be opened, further allowing a surplus of air from the compressed storage means to enter the cockpit, thereby adjusting, by increasing, the volume of the air bubble.

In a further embodiment of the present invention, the air egress control means is provided for purging air from the cockpit when the volume of the air bubble increases beyond a predetermined limit. The air egress control means includes an air exhaust conduit having an egress port integral with the bottom of the float member such that when the float member floats on water, the egress port is normally closed to air by means of the water. However, when the air bubble increases to a volume such that the water level is below the maximum downward travel of the float member, the egress port on the float member will be exposed to the air bubble, thus allowing air to escape from the cockpit.

In a more specific embodiment, the air egress control means includes a two-stage outlet port associated with the float member, wherein the outlet port has a first smaller opening spaced above a larger second opening whereby the first opening will first be exposed to the air bubble as the level of water is lowered by the increasing air bubble for fine adjustment of the volume of the air bubble, and the second larger opening will be exposed to the air bubble only when the smaller opening cannot cope with the degree of adjustment necessary. In practice, the first stage smaller opening will always be operative to exhaust air from the cockpit because of the constant feed of air.

In a still more specific embodiment of the present invention, the cockpit, including the enclosure walls and the canopy is constructed as a separate module which can be fitted within the hull. The cockpit module with its enclosure walls offers added protection to the occupants in the event of a collision or other accident. In such an event, even though the hull may be damaged, the cockpit may stay intact, thus protecting the occupants.

In a still further more specific embodiment of the present invention, the vehicle may be constructed in a modular fashion. Thus, the cockpit may be one module, or it may be integrated with the upper hull portion and motor units as a module. The lower hull portion, the bench with the battery compartment, and the control panel may be other modules. Such a modular construction allows for easier transportation. For instance, a two-man crew may carry the modules and assemble them where necessary.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
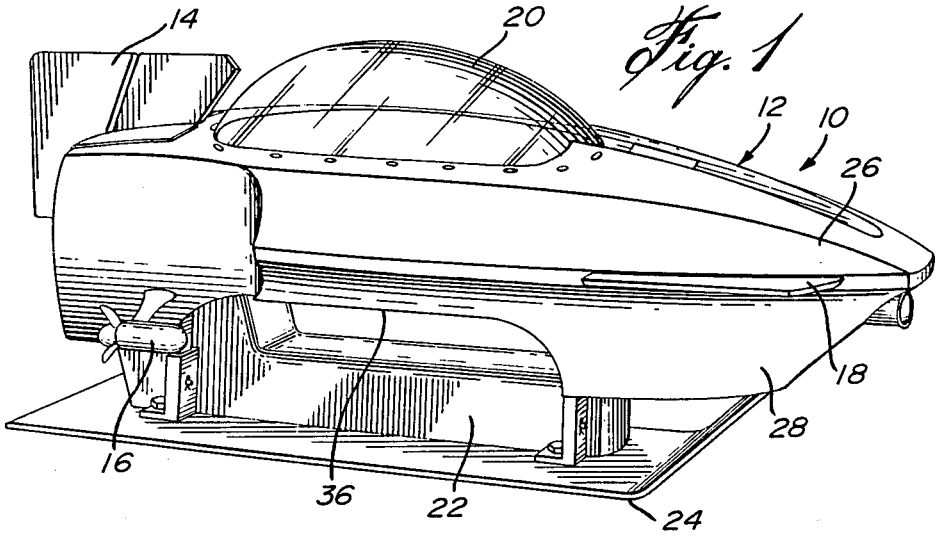
FIG. 1 is a perspective view of a submersible vehicle in accordance with the present invention.
Figure 2:
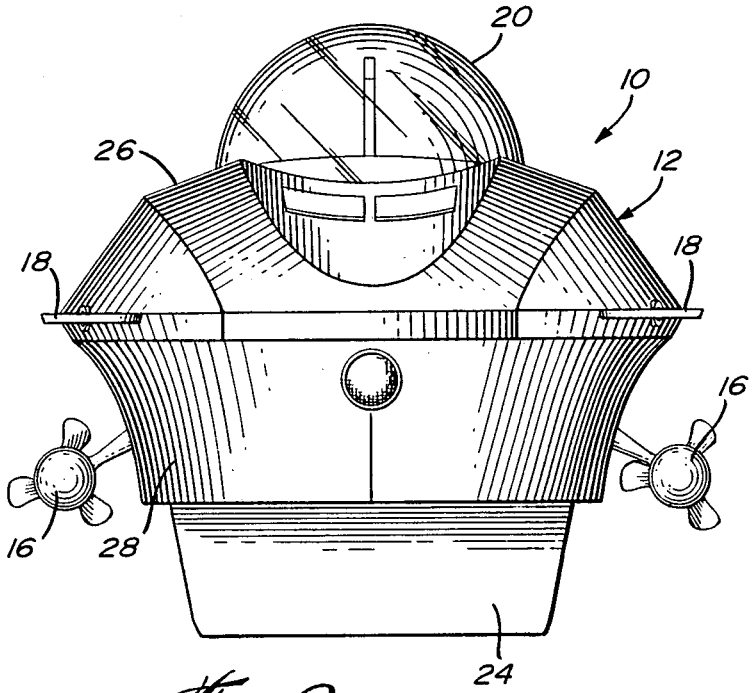
FIG. 2 is a front elevation thereof.
Figure 3:
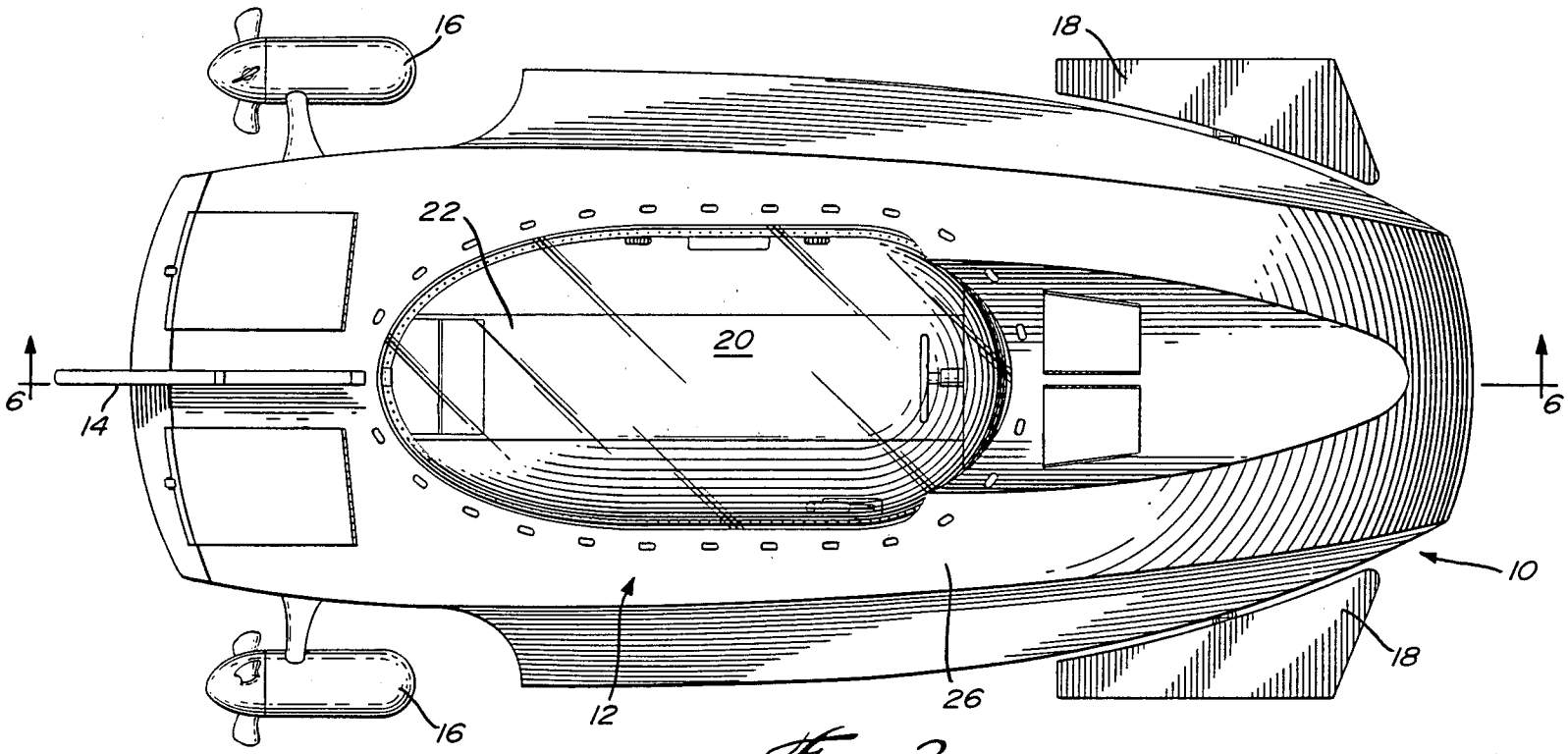
FIG. 3 is a top plan view thereof.
Figure 4:
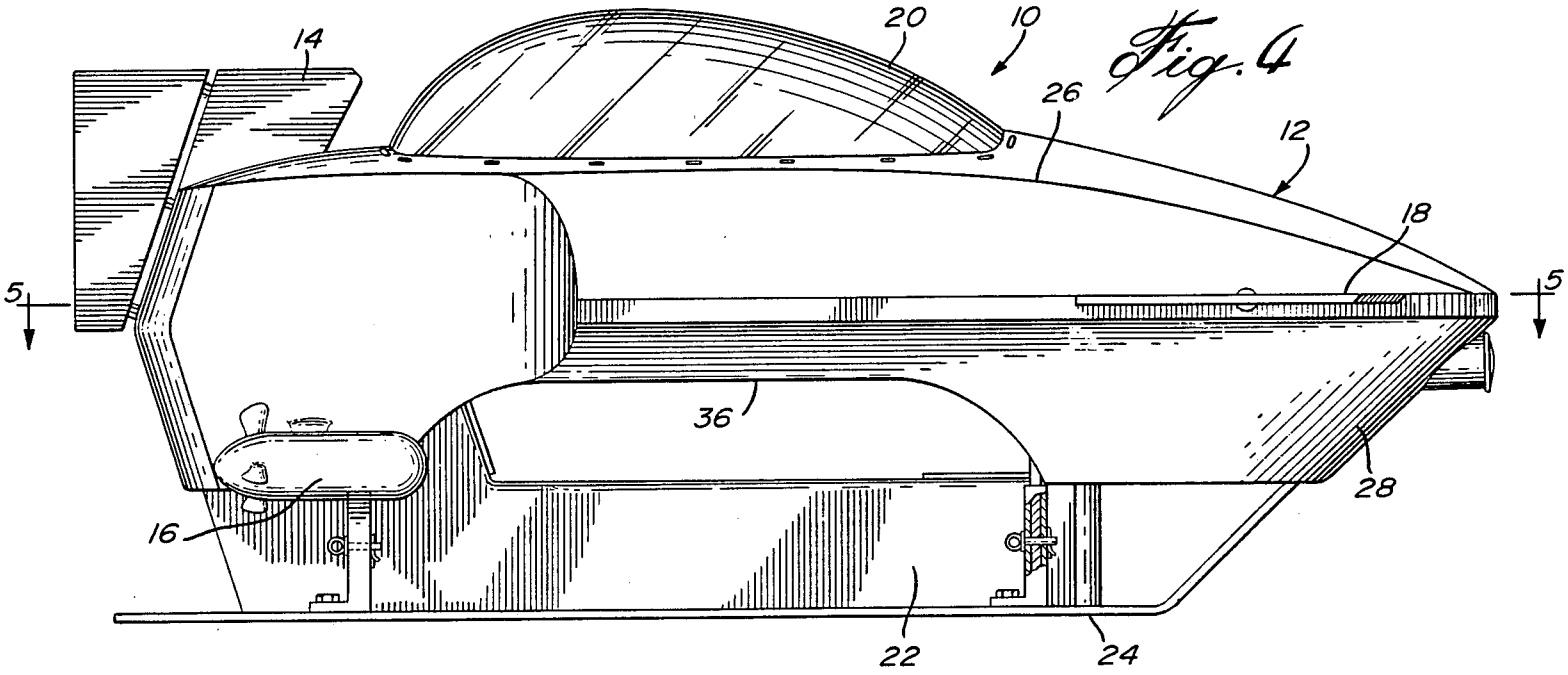
FIG. 4 is a side elevation thereof.

Referring now to the drawings, and in particular to FIGS. 1 through 4, there is shown a self-propelled, submersible, two-man vehicle 10 having a hull 12. Mounted to the hull are a rudder 14 and propeller units 16 on either side of the hull 12, and at the front thereof, pivoting depth attitude flaps 18 mounted for pivoting movement about a horizontal axis.

Centrally of the hull is a dome 20 which is completely transparent. Below the hull 12 is a bench 22 and a runner 24.

The hull includes an upper hull wall 26 and a lower hull wall 28. The hull walls 26 and 28 may be made of fiberglass and are shaped to obtain the lowest possible coefficient of friction. The upper hull wall 26 and lower hull wall 28 are constructed as separate modules and can be joined together.

Figure 5:
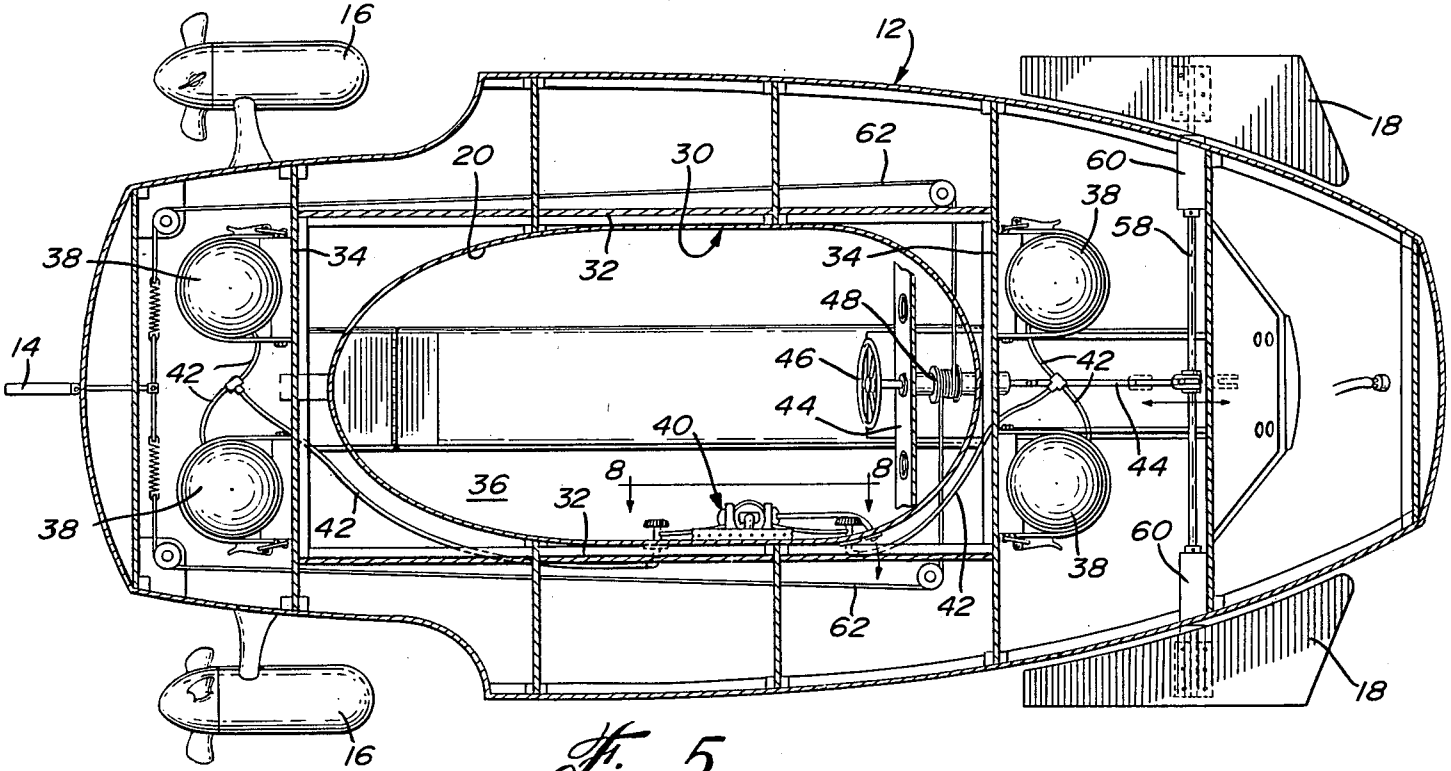
FIG. 5 is a horizontal cross-section taken along line 5—5 of FIG. 4.
Figure 6:
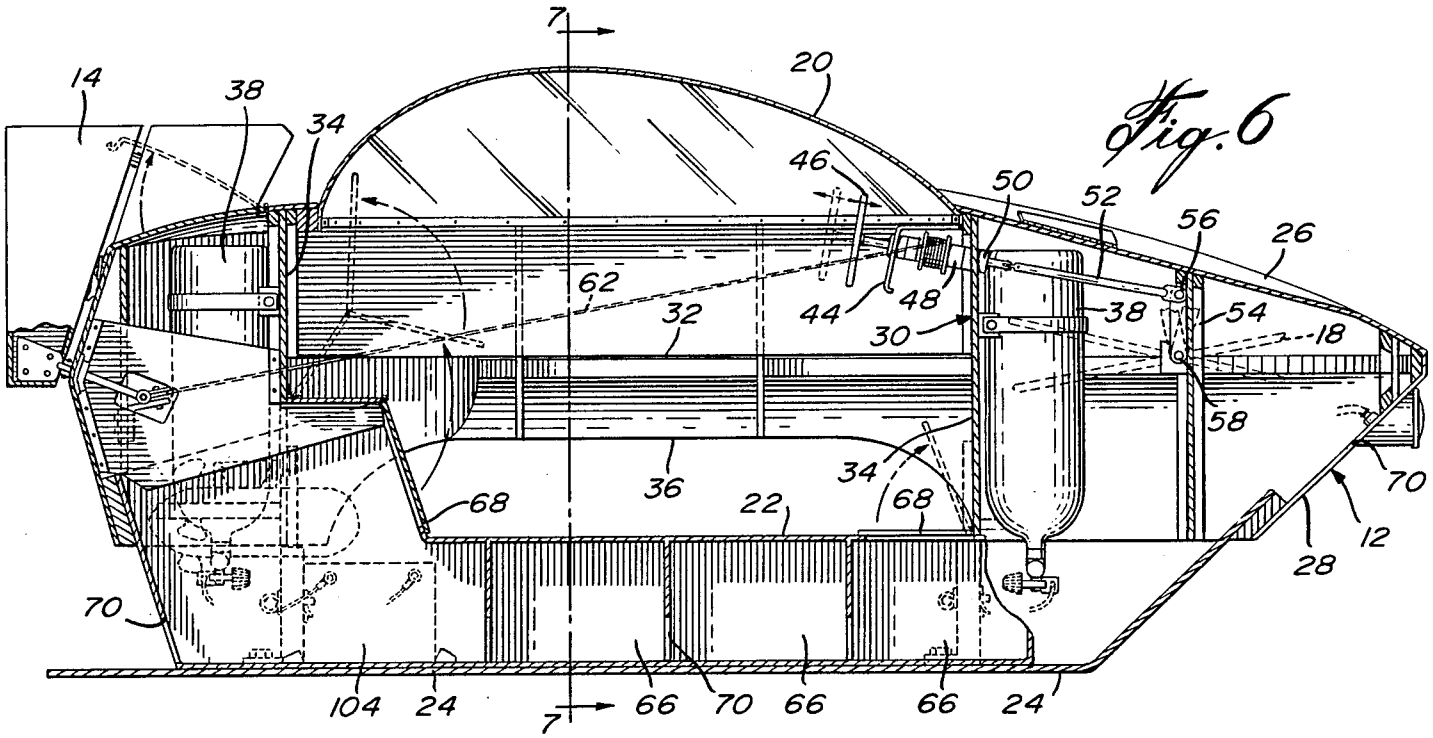
FIG. 6 is a vertical cross-section taken along line 6—6 of FIG. 3.
Figure 7:
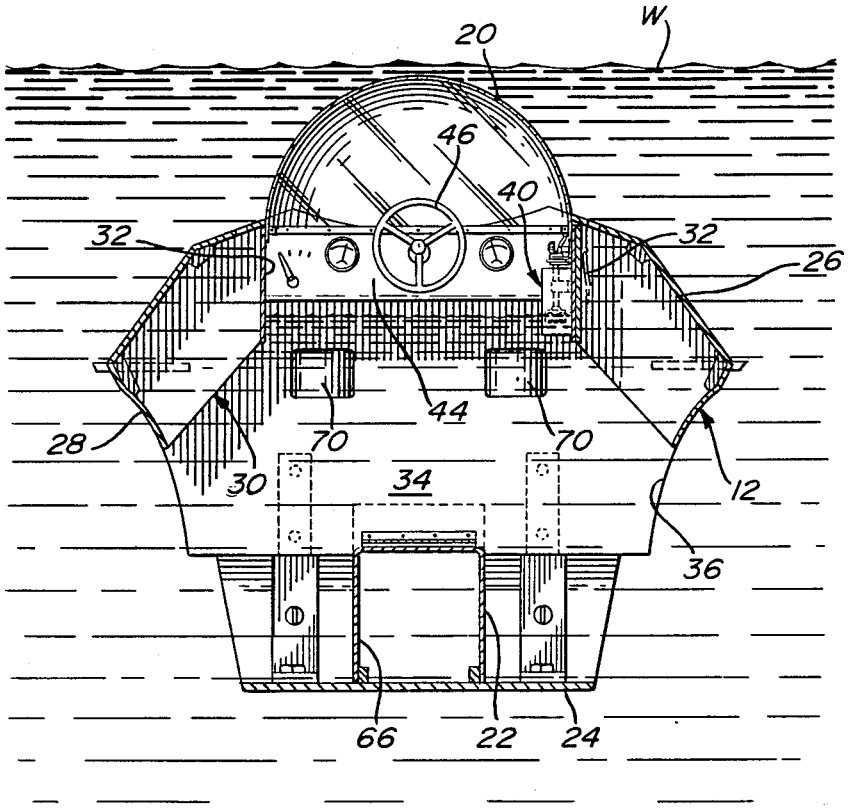
FIG. 7 is a vertical cross-section taken along line 7—7 of FIG. 6.

Referring now to FIGS. 1 through 7, the hull 12 is shown to include a cockpit 30 having side walls 32 and end walls 34 forming the enclosure of the cockpit. The dome 20 is the top wall or canopy for the cockpit 30. The side walls 32 are spaced inwardly from the upper hull wall 26, as shown in FIGS. 5 and 7. The enclosure walls provide an added protection to the occupants within the cockpit. The cockpit 30 may be a separate module or may be integrated in the upper hull 26.

The cockpit 30 is open at the bottom of the hull 12 and includes access opening 36. As shown in FIGS. 5 and 6, the hull is hollow and is capable of being flooded.

In the fore and aft compartments of the hull 12, there are provided pairs of compressed air tanks 38. In the present embodiment, a pair of compressed air tanks is provided at either end of the hull. An air regulating ingress valve 40 is located on the side wall 32 of the cockpit 30, and the valve 40 is connected to the four compressed air tanks 38 by means of a network of flexible conduits 42.

Within the cockpit 30, there is provided, near an end wall 34, a control panel 44 to which is mounted a control wheel 46. The wheel 46 is adapted to both operate the attitude flaps 18 and the rudder 14. Thus, rudder cables 62 connect the rudder 14 to the steering column 48, as shown in FIG. 5. The steering column 48 is, of course, in two parts with a sliding shaft 52 keyed and slidable within the steering column 48. The shaft 52 is linked to a lever 54 by means of pivot connection 56, as shown in FIG. 6. Lever 54 is in turn fixedly connected to a shaft 58 which rotates in bearings 60 and mounts flaps 18 to control the angle of the attitude flaps 18.

The bench 22 is hollow and is provided with ballast compartments 66 which can be flooded by means of flooding openings 70, and/or solid ballasts can be provided in the bench 22, if necessary. As shown, all of the compartments of the hull 12 are capable of being flooded and include various flooding openings 70. The bench 22 and runner 24 may be constructed as a separate module, to be assembled on site.

On the other hand, it is important in this invention to provide an air bubble within the cockpit 30. The air bubble will, of course, form within the canopy 20 and partially within the enclosure walls 32 and 34 forming the upper part of the cockpit. Water will flood into the cockpit to a level which is controllable by the regulating valve system which will now be described.

Figure 9:
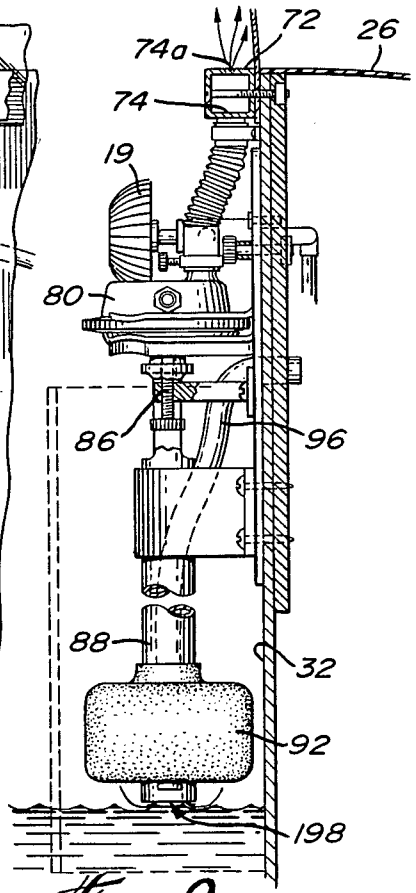
FIG. 9 is a vertical fragmentary cross-section taken along line 9—9 of FIG. 8.
Figure 8:
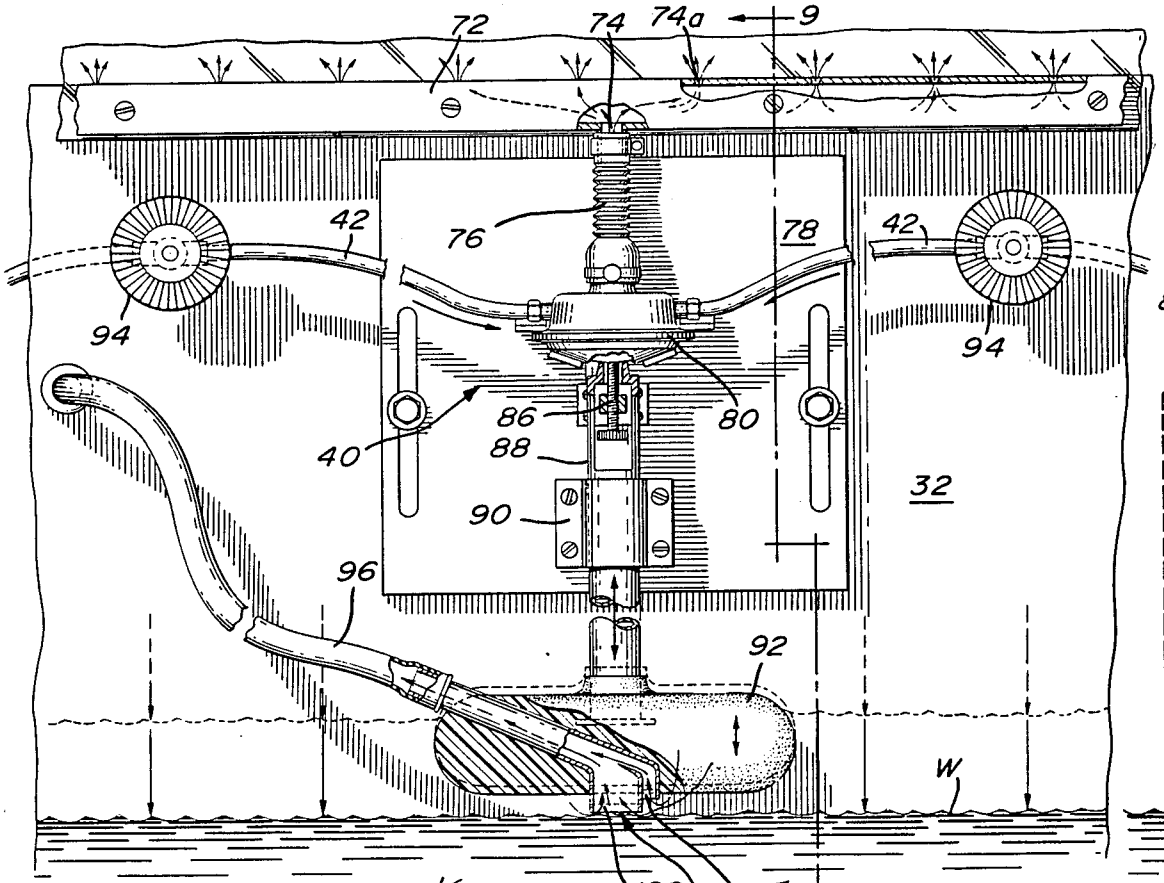
FIG. 8 is an enlarged elevation view of a detail of the present invention, taken along line 8—8 of FIG. 5.

Referring to FIGS. 8 and 9, there is shown a regulating valve 40 which includes a diver's type compression regulator or valve 80 communicating with the compressed air tanks 38 (shown in FIGS. 5 and 6) by means of the conduits 42. Manual valves 94 are provided for alternating the supply of compressed air from one pair of tanks or the other to the regulator valve 40 or for cutting off the air supply completely when the air is no longer needed. Thus, one pair of compressed air tanks 38 can be utilized while the other pair are maintained in reserve.

The regulator valve proper 80 is mounted to the side wall 32 by means of mounting bracket 78. The valve 80 is kept partially opened by means of adjustment screw 86. Plunger 88, which overrides the screw 86, is connected at its other end to a float 92. The plunger 88 slides vertically through bracket 90. The projection 87 on the plunger 88 will depress the regulator valve 80 to allow a greater ingress of air into the cockpit 30 in response to a reduced volume of the air bubble.

The valve 80 is connected to an ingress port 74 provided in the dome trim 72. As shown in FIG. 9, the dome trim 72 can act as a manifold for supplying air through a series of ports 74*a* along the trim 72. When air is being supplied through the ports 74*a*, they also act to defog the dome.

An egress port 98 is arranged in the float 92 and communicates with an exhaust conduit 96 outboard of the vehicle. The egress port 98, which is mounted at the bottom side of the float 92, includes two stage openings, namely, a first upper or smaller opening 100 and a second larger lower opening 102.

In operation, it is required to maintain a predetermined volume of air within the cockpit 30 to provide a breathable atmosphere for the passengers who would normally be sitting on the bench 22 with their heads within the confines of the dome 20. At the same time, the air bubble is required to neutralize the buoyancy of the cockpit. Air is supplied into the cockpit by means of the compressed air tanks 38 communicating through the conduits 42. As previously mentioned, the float 92 will normally be in its lowest position. Air is constantly fed into the cockpit 30 by means of adjustment screw 86 maintaining the regulator valve 80 slightly opened. If the volume of the air bubble should be reduced, the water level in the cockpit will normally rise in view of the lower air pressure within the cockpit, thus moving the float 92 upwardly, causing the plunger and projection 87 to increase the degree of opening of valve 80, allowing air to pass through to the conduit 76 and to ingress into the cockpit by means of the ports 74 and 74a. As the volume of air within the cockpit is increased by means of this supply of air, the water level W will, of course, lower, causing the float 92 to lower as well. If the volume of air should increase beyond the lower limit of travel of the float 92, for instance, when the vehicle rises towards the surface of the water, the air pressure within the cockpit should cause the volume to increase. The egress port opening 100 will first be exposed as the water level W lowers, thereby allowing air to exhaust through the exhaust conduit 98. The opening 100 allows for fine tuning adjustment of the volume. However, if there should be a sudden increase in the volume of air within the cockpit, the opening 102 will be exposed, thereby allowing a greater volume of air to exhaust through the conduit 96. In practice, the opening 100 will mostly be exposed to the air bubble since there is a constant ingress of air into the cockpit 30.

Figure 10:
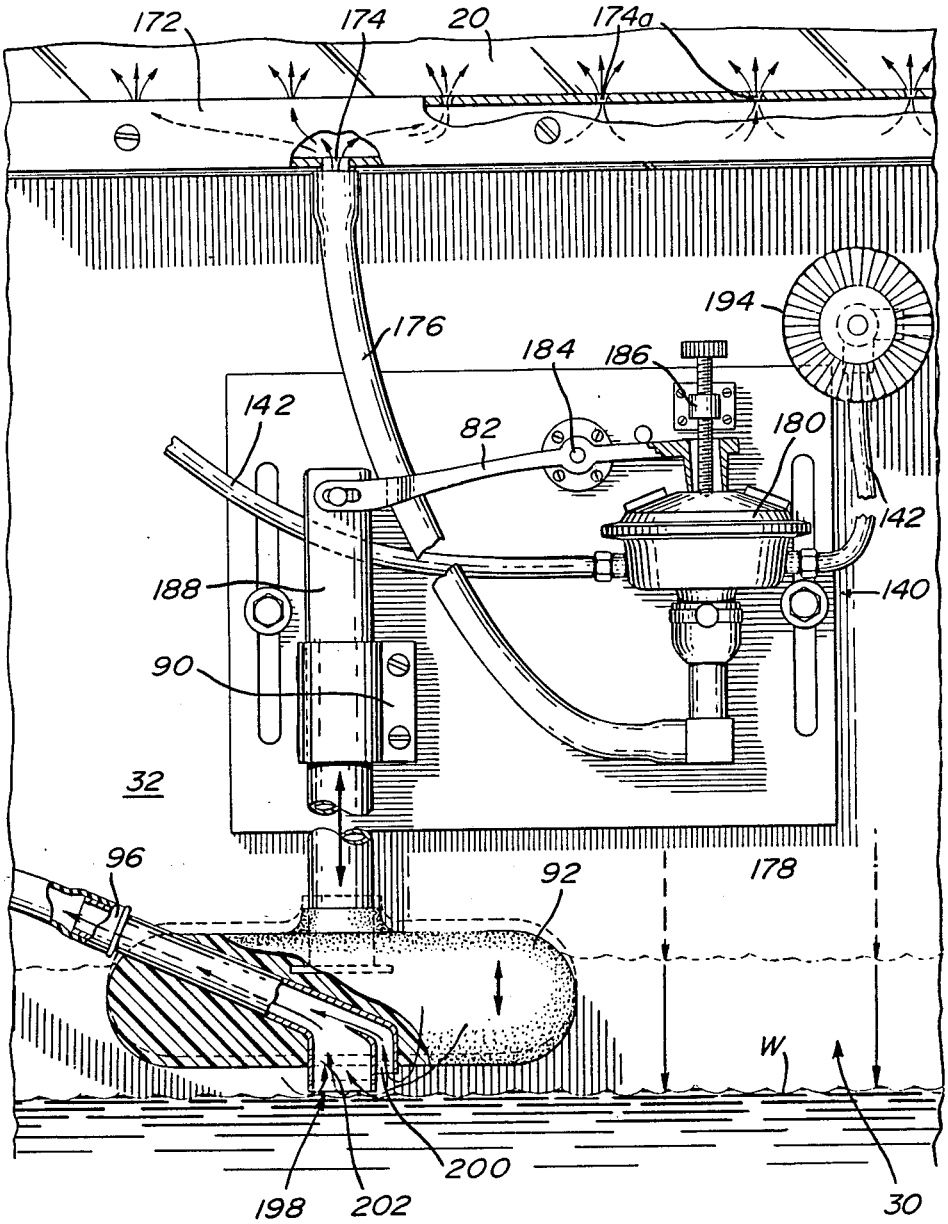
FIG. 10. is an enlarged elevation view, similar to FIG. 8, but of a different embodiment thereof.

Referring now to FIG. 10, there is shown another embodiment of the regulator valve. All the elements in FIG. 10 similar to the elements in FIGS. 8 and 9 have been increased by 100. Thus, the regulator valve 180 is connected to conduits 142 and conduit 176 to ports 174. In this embodiment, the plunger 188 is connected to the valve 180 by means of a lever 182 pivoted at 184 and including at the operative end a projection 187. An adjustment screw 186, mounted to the bracket 178, causes the valve 180 to be partially opened, thus providing a constant ingress of air into the cockpit.

The passengers will have access to the vehicle by means of the opening 36 in the lower hull portion and can sit on the bench 22. The vehicle illustrated in the drawings has a capacity of two passengers. The vehicle can be controlled by means of the control wheel 46 for both depth attitude and direction. The propeller units 16, which would include an electric motor to drive the propeller, may be powered by a battery 104, shown in FIG. 6 in dotted lines.

The submersible vehicle allows the passengers to enter possibly with wet suits but without needing personal breathing equipment. The vehicle can even be used as a diving platform at various depths whereby one of the divers will remain in the vehicle, while the other diver can leave the vehicle and return to the vehicle for air.

We claim:

1. A non-watertight submersible vehicle comprising a hull, an open bottom cockpit having enclosure walls, separate and spaced inward from the hull, and defining open floodable compartments therebetween, and a canopy which is at least partially transparent mounted to the enclosure walls, compressed air storage means provided in the hull and conduit means communicating the compressed air storage means to the cockpit for providing an air bubble within the cockpit, a regulating valve provided on the conduit means for regulating the ingress of air from the compressed air storage means into the cockpit, and an air egress control means coordinated to determine with the regulating valve the volume of air within the cockpit forming the air bubble at varying depths.

2. A submersible vehicle comprising a hull, a cockpit defined within the hull, the hull defining an open accessway to the cockpit to allow passengers unimpeded access to the cockpit from underneath the hull, means provided for supplying air to the cockpit to form an air bubble large enough to allow passengers to breathe freely within the cockpit, compressed air storage means provided in the hull, and conduit means communicating with the compressed air storage means in the cockpit for providing an air bubble within the cockpit, a regulating valve provided on the conduit to regulate the ingress of air from the compressed air storage means to the cockpit, and air egress control means coordinated to determine with the regulating valve the volume of air within the cockpit forming the air bubble at various depths in order to neutralize the buoyancy of the cockpit at such depths, and wherein a gravity-operated, lighter-than-water, float member is operably connected to the regulating valve for regulating the ingress of air into the cockpit in response to the level of water in the cockpit as a result of the volume of the air bubble, and whereby the ingress rate of air is increased as the float member moves from its lowest position to a higher position within the cockpit, the improvement including an adjustment means provided for predetermining a constant flow of air into the cockpit by maintaining the regulating valve partly open and the lighter-than-water float member operably overrides the predetermined constant flow adjustment to increase the rate of flow of air into the cockpit.

3. A submersible vehicle as defined in claim 2, wherein the lighter-than-water float member is provided with a plunger in contact with the regulator valve means such that vertical displacement of the float member causes the plunger to override the constant flow adjustment means to increase the ingress of air into the cockpit and port means are provided for supplying air into the cockpit in the form of an elongated manifold at the base of the canopy with a plurality of distribution ports spaced therealong for allowing the air to ingress at the base of the canopy, thereby helping to defog the transparent portion of the canopy.

4. A submersible vehicle as defined in claim 2, wherein the lighter-than-water float member is provided with a lever pivoted to a mounting bracket which mounts the regulator valve to an enclosure wall of the cockpit, and a link member links the float member to one end of the lever and projections are provided at the other end of the lever for contacting the regulator valve and overcoming the constant flow adjustment means to increase the ingress of air into the cockpit.

5. A submersible vehicle comprising a hull, a cockpit defined within the hull, the hull defining an open accessway to the cockpit to allow passengers unimpeded access to the cockpit from underneath the hull, means provided for supplying air to the cockpit to form an air bubble large enough to allow passengers to breathe freely within the cockpit, compressed air storage means provided in the hull, and conduit means communicating with the compressed air storage means in the cockpit for providing an air bubble within the cockpit, a regulating valve provided on the conduit to regulate the ingress of air from the compressed air storage means to the cockpit, and air egress control means coordinated to determine with the regulating valve the volume of air within the cockpit forming the air bubble at various depths in order to neutralize the buoyancy of the cockpit at such depths, and wherein a gravity-operated, lighter-than-water, float member is operably connected to the regulating valve for regulating the ingress of air into the cockpit in response to the level of water in the cockpit as a result of the volume of the air bubble, and whereby the ingress rate of air is increased as the float member moves from its lowest position to a higher position within the cockpit, the improvement being wherein the egress control means includes egress port means provided in the bottom of the float member such that when the float member floats on the water level within the cockpit, the egress ports are thus shut by the water, and as the water level decreases below the lowest level of the float member, air will be allowed to exhaust through the egress ports in response to the increased volume of the air bubble.

6. A submersible vehicle as defined in claim 5, wherein the egress port means includes a first opening in the bottom of the float member and a second larger opening spaced lower than the first opening such that the first opening provides fine tuning and a constant egress of air from the air bubble when the level of water is slightly below the lowest level of the float member while the second stage opening provides for more abrupt changes in the volume of the air bubble.

7. A submersible vehicle comprising a hull, a cockpit defined within the hull, the cockpit including a canopy having at least a transparent portion which extends over the cockpit and forms the top wall thereof, the cockpit defining enclosure walls and the enclosure walls being sealed to the canopy, the hull also defining an open accessway to the cockpit to allow passengers unimpeded access to the cockpit from underneath the hull, means provided for supplying air to the cockpit to form an air bubble large enough to allow passengers to breathe freely within the cockpit, and means provided for regulating the volume of the air bubble within the cockpit in order to neutralize the buoyancy of the vehicle; the improvement comprising the hull including an upper hull wall and a lower hull wall providing a low coefficient of friction in the water, the cockpit enclosure walls being spaced inwardly from the upper hull wall and defining open floodable compartments therebetween, the canopy being in the form of a transparent dome centrally of the upper hull wall and bench means spaced below the cockpit enclosure walls and longitudinally of the hull and the open accessway being provided within the lower hull wall on either side of the bench means.

8. A submersible vehicle as defined in claim 7, wherein the upper and lower hull walls are detachably separable one from another; the cockpit, including the canopy and enclosure walls, is detachably separable therefrom, all in order to provide a knockdown vehicle.

9. A submersible vehicle as defined in claim 7, wherein two pairs of compressed air tanks are provided fore and aft of the hull within the floodable compartments of the hull, and conduit means are connected to the respective compressed air tanks and to means for regulating the volume of the air bubble, the vehicle being provided with propulsion means and means for providing depth and forward direction and steering.

* * * * *